US005600323A

United States Patent [19]

Boschini

[11] Patent Number: 5,600,323

[45] Date of Patent: Feb. 4, 1997

[54] TELECONTROL SYSTEM WITH A PLURALITY OF FUNCTIONAL RANGES SELECTED BY DETECTION THRESHOLD

[75] Inventor: Alain Boschini, Nanterre, France

[73] Assignee: Valeo Electronique, Creteil, Cedex, France

[21] Appl. No.: 260,955

[22] Filed: Jun. 16, 1994

[30] Foreign Application Priority Data

Jun. 21, 1993 [FR] France ..... 93 07481

[51] Int. Cl.[6] ..... G08C 19/12

[52] U.S. Cl. ..... 341/173; 340/825.69; 340/825.72

[58] Field of Search ..... 340/825.69, 825.72, 340/825.71, 825.77, 425.5, 426; 341/173; 307/10.1–10.8; 455/134; 361/171, 172

[56] References Cited

U.S. PATENT DOCUMENTS

| | | | |
|---|---|---|---|
| 4,942,393 | 7/1990 | Waraska et al. | 361/172 |
| 4,973,958 | 11/1990 | Hirano et al. | 340/825.72 |
| 4,996,525 | 2/1991 | Becker, Jr. et al. | 361/172 |
| 5,109,221 | 4/1992 | Lambropoulos et al. | 340/825.72 |
| 5,193,210 | 3/1993 | Nicholas et al. | 455/38.1 |
| 5,319,364 | 6/1994 | Waraksa et al. | 340/825.72 |
| 5,355,525 | 10/1994 | Lindmayer et al. | 340/825.69 |
| 5,379,033 | 1/1995 | Fuji et al. | 340/825.69 |

FOREIGN PATENT DOCUMENTS

| | | |
|---|---|---|
| 0524424 | 1/1993 | European Pat. Off. . |
| 4226053 | 2/1993 | Germany . |

OTHER PUBLICATIONS

Abstract of Japan Publication No. JP2217580.

*Primary Examiner*—Jeffery Hofsass
*Assistant Examiner*—Ashok Monnava
*Attorney, Agent, or Firm*—Morgan & Finnegan, LLP

[57] ABSTRACT

A telecontrol system for the remote execution of functions comprising actuation of devices in a motor vehicle, for example operation of courtesy lights and locking and unlocking of the doors, comprises a receiver module mounted on the vehicle and an emitter unit carried by the user for transmitting coded radio signals to the receiver module. A data signal configuring circuit of the receiver module has a detection threshold level which is regulated according to predetermined zones of functional ranges between the emitter and the receiver module, around the vehicle, in such a way that a function on the vehicle which is controlled by the emitter is only validated if the emitter is in the appropriate zone of functional range.

4 Claims, 4 Drawing Sheets

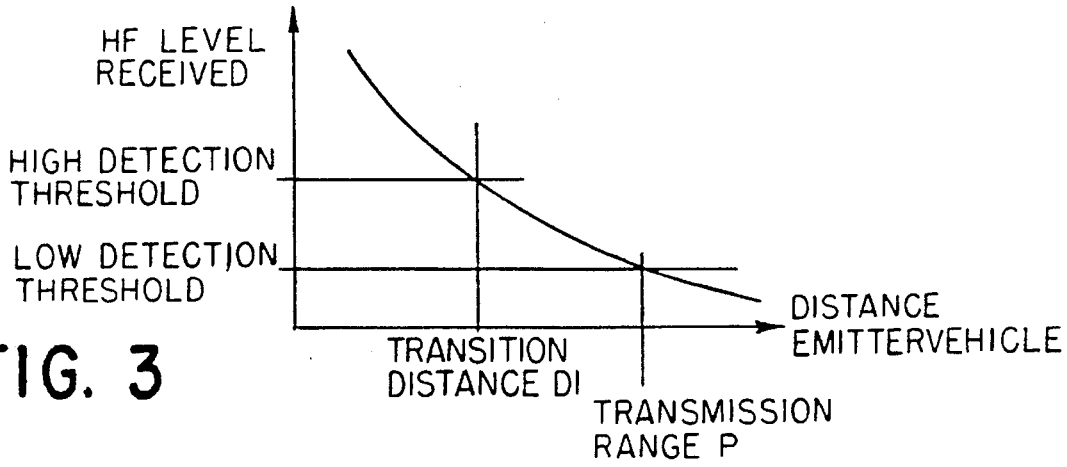
FIG. 3
FIG. 5
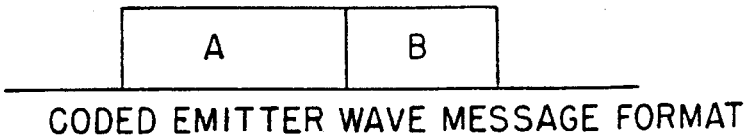
FIG. 6
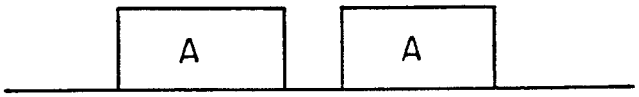
FIG. 7
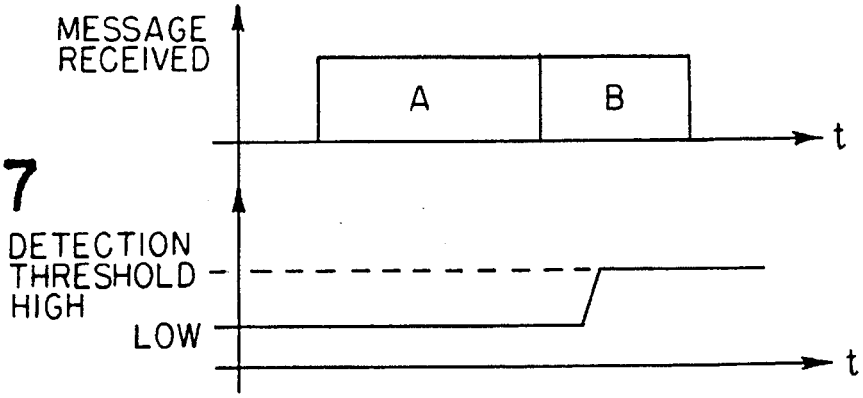

TELECONTROL SYSTEM WITH A PLURALITY OF FUNCTIONAL RANGES SELECTED BY DETECTION THRESHOLD

FIELD OF THE INVENTION

This invention relates to a telecontrol system for the remote execution of functions comprising the actuation of devices in a motor vehicle. The invention lies in particular in the field of telecontrol systems for, in particular, controlling access to a motor vehicle.

BACKGROUND OF THE INVENTION

Known types of telecontrol system generally include, and as indicated diagrammatically in FIG. 1 of the accompanying drawings, a portable emitter 10 which is carried by a user, together with a receiver module 20 which is fitted in a motor vehicle 30. The emitter 10 is so designed as to generate a coded wave 10*a*. A "coded wave" is to be understood to mean a wave which carries information or data in the form of a control or command signal. Such a coded wave may be produced by radio transmission, light transmission, infrared transmission or ultrasonic transmission, though this list is not exhaustive.

The receiver module 20 is so designed as to detect the coded wave generated by the emitter, and to decode the latter. When the code generated by the emitter 10 corresponds to one or more predetermined codes, the receiver causes locking and unlocking of the doors of the motor vehicle 30, or the operation of various auxiliary functions of the vehicle, to be carried out.

Telecontrol systems using a coded wave, with radio transmission in particular, are of very flexible application, to the extent that firstly, the user has no need to orientate the emitter towards the vehicle in order to establish transmission, and secondly, the transmission may be established at a distance of some tens of meters from the vehicle.

Generally, in the higher quality systems, the emitter 10 has a set of touch keys which are associated with particular functions in the vehicle, for example locking of the doors, unlocking of the doors, operation of the courtesy lighting or the driving or parking lights of the vehicle, closing of the windows, and activation of an alarm. Since each function has its own touch key, the size of the portable emitter unit itself is quite large, and the presence of too many touch keys detracts from the convenience of the user.

For certain control functions, such as unlocking the doors and closing the windows remotely, a high transmission range can be a factor which is detrimental to security. Accidental touching of the touch keys of the emitter unit could in this connection cause the doors to become unlocked without the user being aware of it.

On the other hand, there are some functions, such as remote control of courtesy lights or other lights in the vehicle, which it may be convenient or desirable to operate remotely from quite a long distance away, for example for the purpose of remote inspection of the vehicle, in a parking lot for instance. Under these circumstances, a transmission range of several tens of meters is desirable.

It is thus apparent that with known conventional telecontrol systems, the compromise between convenience or use of the telecontrol system on the one hand, and security considerations on the other, leads to the choice of a transmission range of between 5 and 10 meters. This transmission range favors security at the expense of convenience.

DISCUSSION OF THE INVENTION

An object of the present invention is accordingly to improve these systems by removing the need to make such a compromise, and to reduce the number of touch keys in the emitter unit.

This object is achieved by the provision of a plurality of operating zones, or zones of operating range, around the vehicle. In this connection reference is made to FIG. 2 of the accompanying drawings, which show a near zone F1 around the vehicle and a far zone F2 surrounding the zone F1. An authorized zone, F2 or F1 or both, is attributed to each of the functions to be actuated in the vehicle. Some functions (here said to be of the type F1) can thus only be controlled in zone F1 which is delimited by the transition distance D1. On the other hand other functions (here said to be of the type F2) can be controlled in zone F2, which is bounded by the system transmission range P and the distance D1.

The system which is the subject of the present invention can also include further functional zones delimited by transition distances D2, D3, to which functions of type F2, F3 would be associated. For practical reasons, however, the description that follows will relate only to a system with two functional zones, but by way of example only.

The invention also provides a system in which a single touch key of the telecontrol system (i.e. on the emitter unit) enables a plurality of functions on the vehicle to be executed according to the distance prevailing between the emitter and the vehicle when the touch key is operated. For example, touching key No. 1 may cause the courtesy light to be illuminated when the user is in zone F2, but when he is in zone F1, it will unlock the doors.

This system provides both security and convenience in the same telecontrol system, and with the use of few touch keys.

According to the invention, a telecontrol system for remote actuation of devices in a motor vehicle, and especially for actuating the locking and unlocking of the doors of the vehicle, the system being of the type comprising a portable emitter adapted to generate a coded electromagnetic wave, and a receiver module located in the vehicle and arranged for receiving and decoding the coded electromagnetic wave generated by the portable emitter, the latter including a processor, a radio emitter, a group of touch keys, and a power supply source in the form of batteries, the receiver module having a receiving antenna, a radio receiving circuit, a circuit for configuring demodulated signals, a processor for processing the data, and an actuating circuit for actuation of the electromagnetic devices in the vehicle, is characterized by the fact that the processor includes a control means for controlling a detection threshold of the circuit for configuring the demodulated signals, whereby to define a plurality of zones of functional range around the vehicle.

A preferred embodiment of the invention, in the case in which the invention is applied to radio transmission to a motor vehicle, will be described below, by way of example only and with reference to the accompanying drawings.

BRIEF DESCRIPTION OF THE DRAWINGS

FIG. 3 shows the curve of the level of the HF signal received, as a function of the distance between the emitter and the vehicle.

FIG. 5 shows one example of the format of data transmitted by the emitter.

FIG. 6 shows a modified format of data transmitted by the emitter.

FIG. 7 is a time diagram for the operation for control of the detection threshold.

DESCRIPTION OF PREFERRED EMBODIMENTS OF THE INVENTION

Given that the level of the HF signal which is received on the antenna of the receiver is a function of the distance between the emitter and the receiver, and that the variation in this level as a function of distance follows a decreasing law as indicated in FIG. 3, it is possible, for a given emitter and a given vehicle, to determine the approximate distance between the emitter and the vehicle by detecting the signal level of the HF signal received.

Figure 1:
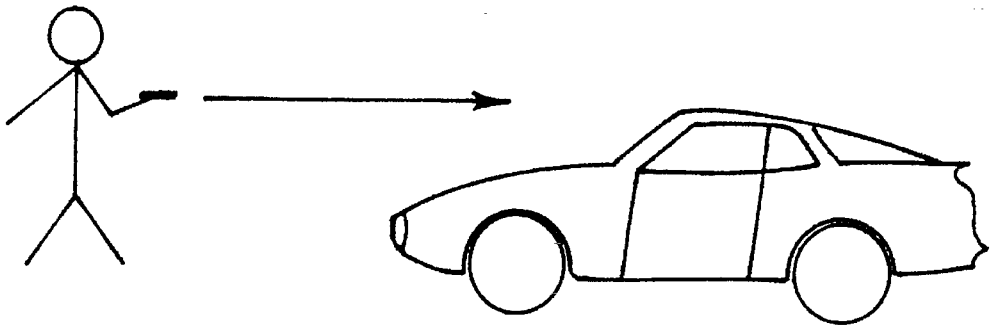
FIG. 1 PRIOR ART
FIGS. 1 and 2 have already been described above.
Figure 2:
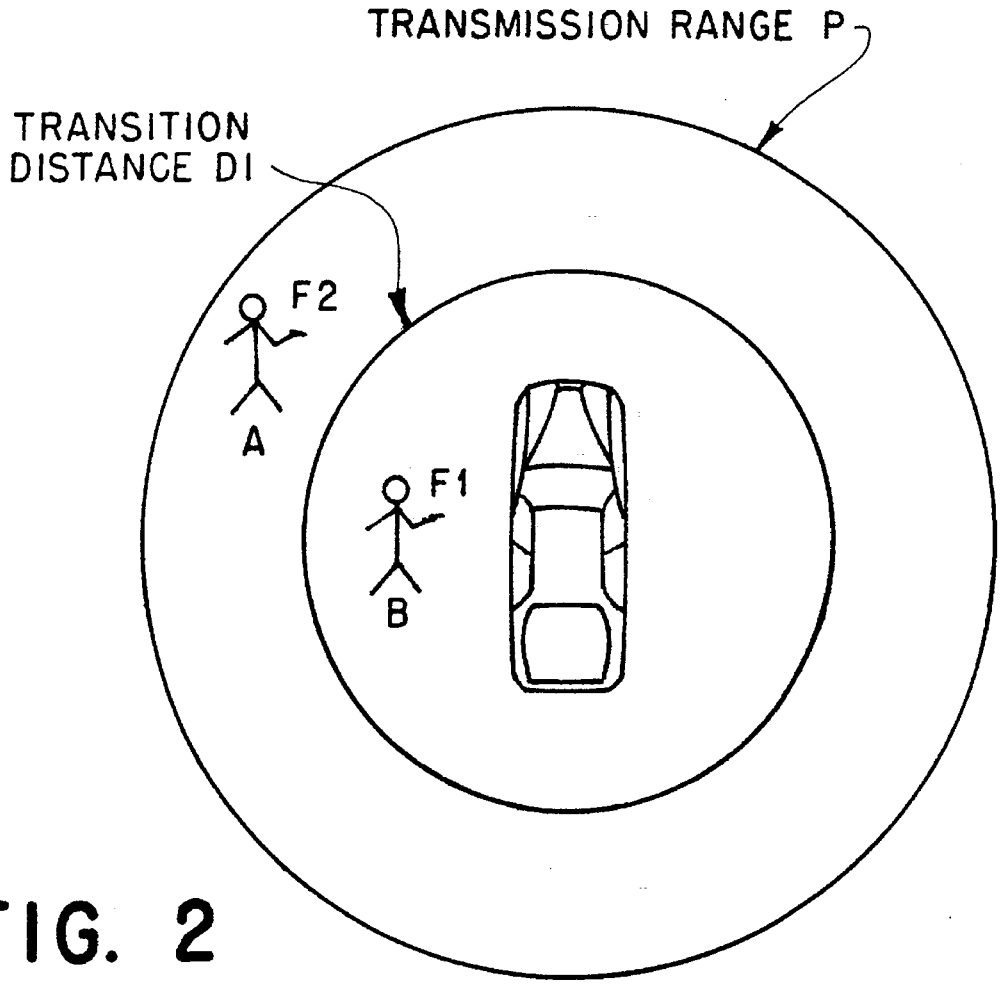

Thus, on the level of the received wave (in this example a high frequency or HF signal), a high detection threshold is defined which corresponds to the transition distance D1 (on the abscissa in FIG. 3 and in the corresponding circle in FIG. 2) and a low detection level which corresponds to the limiting transmission range P (again indicated on the abscissa in FIG. 3, and the corresponding circle in FIG. 2). It is clear that it is possible to choose a number of intermediate levels D2, D3 etc. between D1 and P, which are determined in advance and which are represented by values which are entered in advance in a memory in the receiver module 30.

Figure 4:
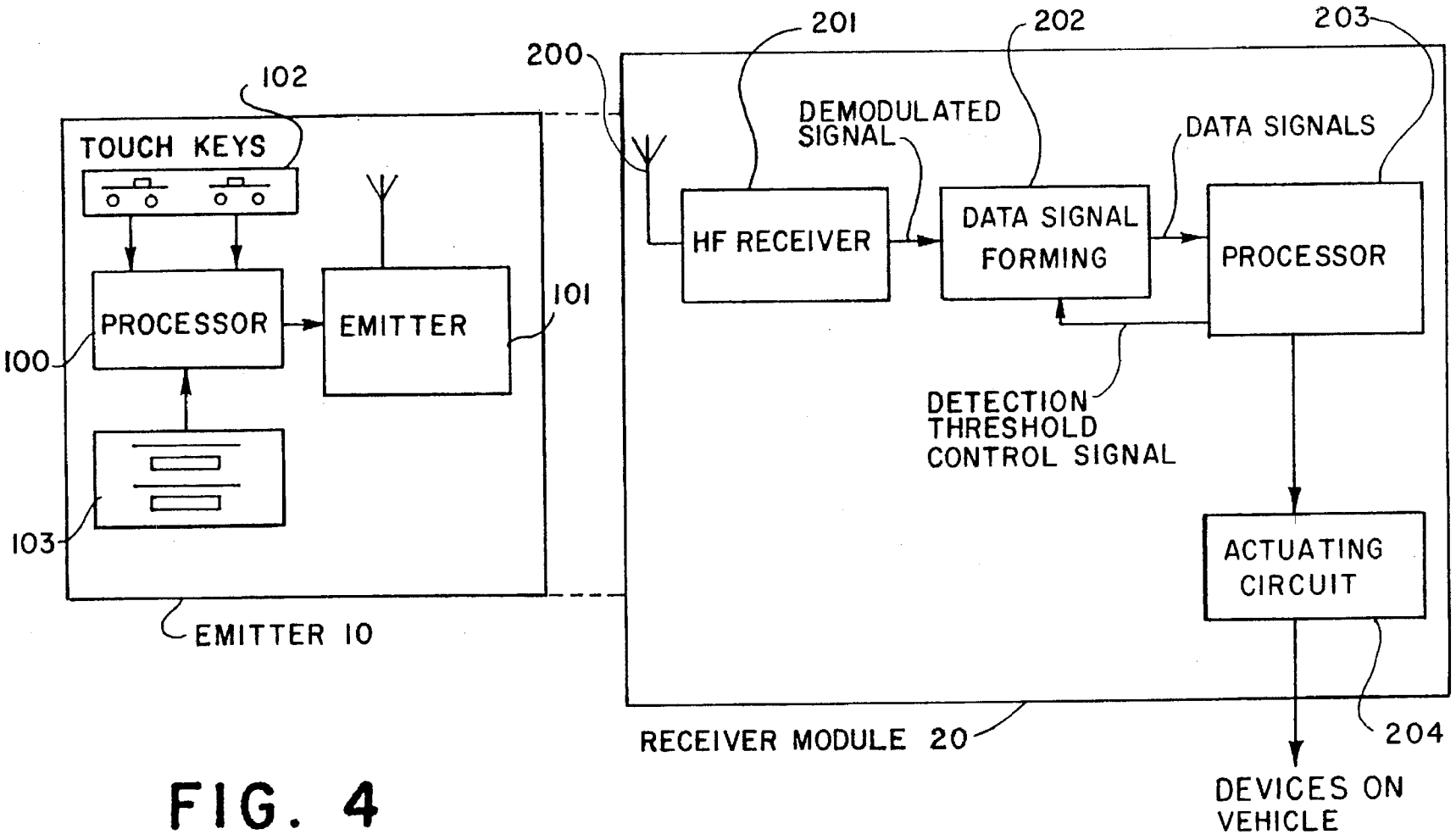
FIG. 4 is a diagram, in the form of operational block diagrams for the radio telecontrol system in accordance with the present invention.

As shown in FIG. 4, the emitter includes a first processor 100, a radio emitter 101, a group of touch keys 102, and a power source in the form of batteries 103.

The receiver module comprises a radio receiving circuit 201 having an HF antenna 200, a circuit 202 for processing demodulated signals, a second processor 203 for configuring (forming) data signals, and an actuating circuit 204 for actuating electromagnetic devices on the vehicle.

The radio receiving circuit 201 is arranged to amplify and demodulate the coded radio wave received on the receiver antenna 200. This radio receiving circuit 201 supplies to the data signal configuring circuit 202 an analog signal which represents the coded message emitted by the emitter 10. The data signal configuring unit 202 supplies to the processor 203 one or more logic data signals which are adapted to the particular method of acquisition and decoding of the data in the coded message that are employed in the system, according to the application concerned. The processor 203 includes means for switching the demodulated signals from a detection threshold of the data signal forming circuit 202. Using this switching means, the processor 203 controls, by means of a control signal, the detection threshold of the data signal configuring circuit 202, in such a way that the signal level of the received HF signal can be detected. The said control signal works in the following way.

When the threshold control signal is at logic level 0, the detection threshold is adjusted to its low level (see FIG. 7). All the electromagnetic signals which are received on the receiver antenna 200, which produce at the output of the HF receiving circuit 201 demodulated signals at levels which are greater than this low detection threshold, are configured by the circuit 202 and entered or made use of by the actuating circuit 204. The low detection threshold level thus determines the transmission range P of the system.

When the control signal is at logic level 1, the detection threshold is adjusted to its high level (see FIG. 7). All the electromagnetic signals received on the receiver antenna 200 which produce, at the outlet of the HF receiving circuit 201, demodulated signals at levels which are lower than the high detection threshold, are not formed by the circuit 202 and are therefore not entered in the processor 203 or made use of by it. The high detection threshold level thus determines the transition distance D1 of the system.

The processor 203 puts the detection threshold at its low level by default, in order that it can receive all the coded waves emitted from the zones F1 and F2.

Each time a touch key 102 of the emitter, or a combination of these touch keys, is activated, the processor 100 generates a coded wave which is composed, as is shown in FIG. 5, partly of coded data A and partly of coded data B. The part of the coded data A contains the data for identification of the emitter, while the part B contains only elementary data for the purpose of verifying that the receiver module is capable of receiving them. In particular, the second part of the message is arranged to enable the level of the signals received by the receiver module 20 to be detected.

Let us first consider the case in which the emitter is located within zone F2. When the emitter transmits a coded wave, the MF receiver 201 supplies demodulated signals at a level which is .greater than the low detection level of the data signal configuring circuit 202, but lower than the high detection level. In the case in which more than two zones of functional range are predetermined, the detection threshold switching means of the data signal configuring circuit 202 selects the detection threshold level which corresponds to the zone of functional ranges associated with the command received, as it is represented in the first part of the message. A plurality of threshold levels may be recorded or predetermined in addition.

Figure 8:
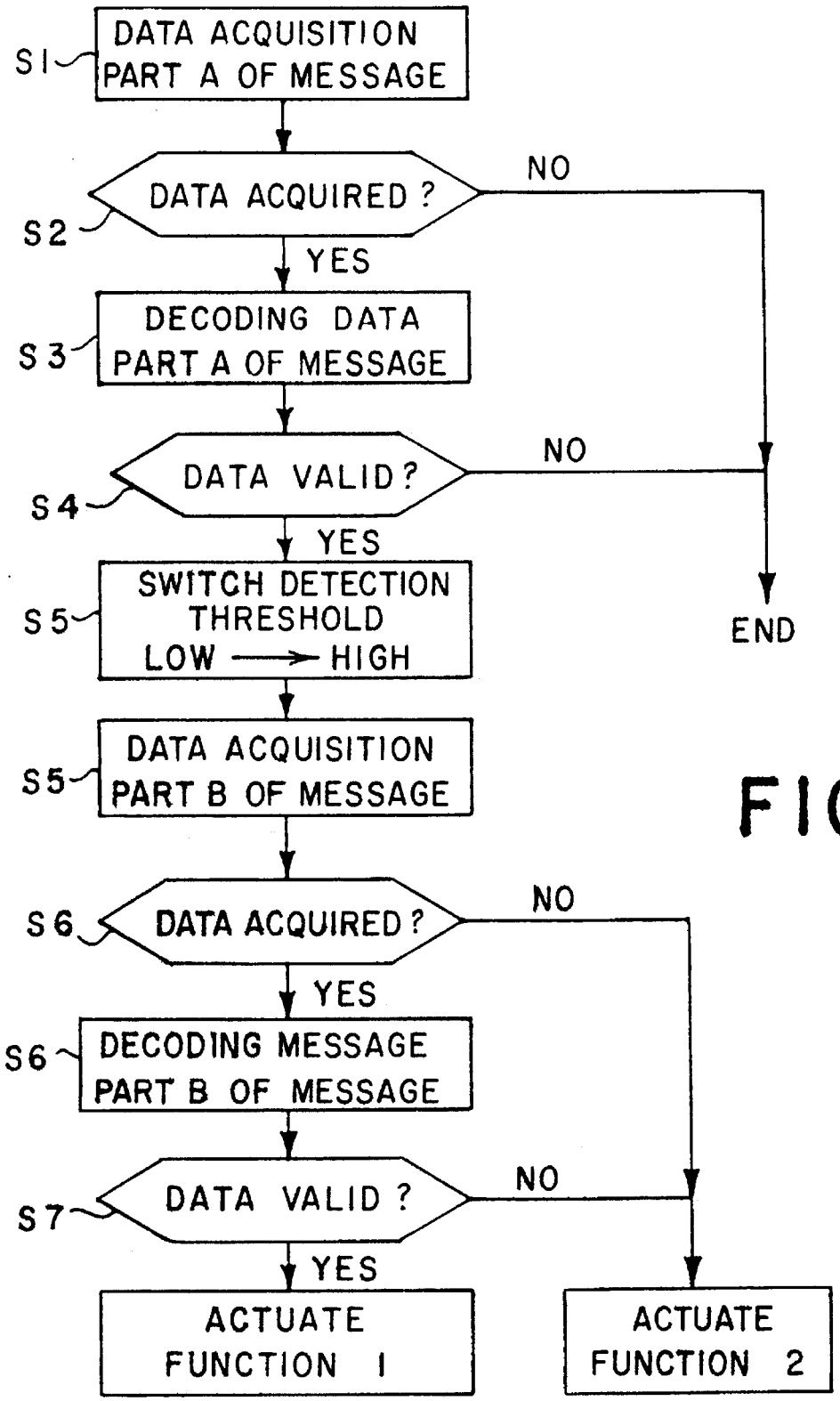
FIG. 8 is a time diagram for the operation of the receiver module in one radio transmission application.

When the coded wave is received, as indicated in FIG. 8, the processor 203 sets in train the execution of a number of operations for the purpose of determining, firstly, the validity of the received coded data, and secondly, the device which is to be actuated by the circuit 204.

The time diagram in FIG. 8 will assist in giving a better understanding of the chronological train of events in these operations. The operations carried out by the processor 203 are as follows.

S1: the processor 203 of the receiver module 20 acquires the data in the part A of the message transmitted by the emitter 10.

S2: when the processor 203 has acquired all the data, it decodes them and verifies their validity.

S3: if the processor 203 considers that the data are valid, it activates the control signal for the detection threshold of the data signal forming circuit 202, in order to shift the detection threshold to its high level.

S4: after the time necessary for stabilization of the analog signals in the data signal forming circuit has elapsed, the processor initiates the process of acquiring data from the part B of the message transmitted by the coded wave.

S5: since the demodulated signals provided by the HF receiver 201 are lower than the high detection threshold of the data signal forming circuit 202, no logic data signal is transmitted to the processor 203. The processor thus cannot acquire data from the part B of the message transmitted by the emitter. It therefore controls the function F2.

The case in which the emitter is located in zone F1 will now be considered. When the emitter transmits a coded Wave, the HF receiver 201 supplies demodulated signals at a level which is higher than both the high and low detection thresholds of the data signal forming circuit 202.

The operations proceed as in the preceding case, up to phase 4, after which they proceed in the following way.

S5: since the demodulated signals supplied by the HF receiver 201 are at a higher level than the high detection level of the data signal forming circuit 202, the logic data signals are transmitted to the processor 203. The processor is thus able to acquire the data in B of the message transmitted by the emitter.

S6: when the processor 203 has acquired all of the data, it decodes them and verifies their validity.

S7: if the processor 203 considers the data to be valid, it then actuates the function F1.

The format of the data message may be different from that indicated in FIG. 5. The principle claimed in the claims of the present application may for example be applied to a message format such as that which is indicated in FIG. 6, in which the messages A are repeated at least once.

The part B of the message may also be reduced to uncoded data.

What is claimed is:

1. A telecontrol system for remote execution of functions for actuating devices in a motor vehicle, comprising a portable emitter for generating a message that is at least partially encoded and a receiver module located in the vehicle, the emitter having a first processor, an emitter connected to the processor for receiving signals therefrom, a group of touch keys for activating the first processor to provide input signals thereto, and a power supply source for the processor and emitter, the receiver module having a receiving circuit for receiving the message generated by the emitter and for decoding the at least partially coded message to give demodulated output signals, a data signal configuring circuit connected to the output of the receiving circuit, a detection threshold switching circuit in said data signal configuring circuit for selecting the detection threshold, said detection threshold corresponding to one of a plurality of predetermined zones of distance from the vehicle, a second processor connected to the output of the data signal configuring circuit for processing the data signal received therefrom, and an actuating circuit for actuating electromagnetic devices of the vehicle to execute functions that each correspond to a respective individual zone, the actuating circuit being connected to the second processor to receive command signals from the second processor, wherein the second processor includes control means for controlling within the receiver module a detection threshold of the data signal configuring circuit to define within the receiver module one of the plurality of zones of functional range around the vehicle.

2. A telecontrol system according to claim 1, wherein the emitter is arranged to formulate a signal in the form of the coded message comprising at least two parts, one of the parts being adapted to verify validity of the signal and to establish the function that is to be executed, and another part of the signal being adapted to enable the level of the signals received by the receiver module to be detected and control the actuating of the function.

3. A telecontrol system according to claim 2, wherein the detection threshold switching circuit further comprises means for switching the detection threshold between a high level and a low level in response to the reception and decoding of the one part of the message, to define in which functional range the portable emitter must be in order that the second part of the signal be detected.

4. A telecontrol system according to claim 1, adapted so that a single actuation of one of said touch keys causes within the receiver module the execution of a plurality of predetermined functions to selectively activate the motor vehicle devices in accordance with the particular zone of functional range in which the emitter is located in response to the command signals from the second processor within the receiver module wherein at least one function in the vehicle can be executed for each zone in which the emitter is located.

* * * * *